United States Patent [19]

Ludscheidt

[11] Patent Number: 4,547,928

[45] Date of Patent: Oct. 22, 1985

[54] TOOL FOR CLEANING AND REMOVING DEPOSITED MATERIAL, PARTICULARLY FROM MOTOR VEHICLE BRAKE DRUMS

[76] Inventor: Horst Ludscheidt, Westfälische Str. 171, 4600 Dortmund 12, Fed. Rep. of Germany

[21] Appl. No.: 543,096

[22] Filed: Oct. 18, 1983

[30] Foreign Application Priority Data

Oct. 22, 1982 [DE] Fed. Rep. of Germany ..... 3239150

[51] Int. Cl.[4] ..... A47L 5/00

[52] U.S. Cl. ..... 15/364; 15/382; 173/78

[58] Field of Search ..... 15/382, 344, 398, 400, 15/365, 379, 364; 173/72, 73, 78, 80, 75

[56] References Cited

U.S. PATENT DOCUMENTS

| | | | |
|---|---|---|---|
| 1,007,888 | 11/1911 | Parker | 15/382 X |
| 3,276,066 | 10/1966 | Chiba | 15/382 X |
| 3,511,322 | 5/1970 | Bixby et al. | 173/75 |
| 4,036,308 | 7/1977 | Dellenberg | 173/75 |
| 4,209,069 | 6/1980 | Smith | 173/75 |
| 4,447,931 | 5/1984 | Lindqvist | 15/365 |

FOREIGN PATENT DOCUMENTS

| | | | |
|---|---|---|---|
| 1109844 | 10/1952 | Fed. Rep. of Germany | 15/382 |
| 2752842 | 5/1979 | Fed. Rep. of Germany | 15/398 |
| 2419117 | 10/1979 | France . | |
| 289367 | 4/1928 | United Kingdom | 15/382 |
| 1542590 | 3/1979 | United Kingdom . | |
| 454026 | 2/1975 | U.S.S.R. | 15/382 |

*Primary Examiner*—Philip R. Coe
*Assistant Examiner*—Frankie L. Stinson
*Attorney, Agent, or Firm*—Toren, McGeady, Stanger, Goldberg & Kiel

[57] ABSTRACT

A tool for removing solid deposited material from a surface to be cleaned, such as for cleaning material from the brake drums of motor vehicles and for removing the material, includes a member for loosening the deposited material and a connection to a vacuum source for removing the loosened material. The loosening member is a manually operable cutting head including an impact element located at one end of a tubular member. During use, the impact element performs a stroke-like movement. The other end of the tubular member forms a connection to the vacuum source.

15 Claims, 3 Drawing Figures

TOOL FOR CLEANING AND REMOVING DEPOSITED MATERIAL, PARTICULARLY FROM MOTOR VEHICLE BRAKE DRUMS

SUMMARY OF THE INVENTION

The present invention is directed to a tool for removing solid deposited material on surfaces to be cleaned, particularly for cleaning material from the brake drums of motor vehicles and for removing the material. The tool includes a member for loosening the deposited material and a connection to a vacuum source.

In a preferred use of the present invention, that is, cleaning the brake drums of motor vehicles, there is the problem that the material to be cleaned, as a rule, contains asbestos, and care must be taken that the dust resulting from the cleaning operation is not released into the surrounding air, since it could greatly endanger the health of the person performing the cleaning operation.

In a brochure of Norfi Umwelttechnik GmbH, Lübeck, there is disclosed the combination of a passenger vehicle suction bell and an industrial vacuum cleaner with the bell formed as a sheet metal part and equipped on one side with overlapping rubber elements so that it can be fitted on the wheel hub. The other side of the bell has a through-opening for a compressed air gun so that an operator can loosen deposited material by means of compressed air. A hose connects the bell to the industrial vacuum cleaner.

This known solution has a number of considerable disadvantages. In particular, it is very unwieldy, since its use always requires a separate compressed air source, and, although it has a viewing window, the operator cannot always see the areas to be cleaned. This known device cannot be used for cleaning motor truck brake drums if they are located on the interior, since the device can only be positioned from the outside.

Therefore, it is the primary object of the present invention to provide a tool for carrying out the cleaning and removal operation which affords simplified handling and which dispenses with the use of the compressed air source. Further, the tool can be utilized for cleaning any part of the motor vehicle regardless of its location.

In accordance with the present invention, the tool for cleaning and removing deposited material includes a manually operable cutting head including at least one impact element performing a stroke-like movement and a connection to a vacuum source located on the cutting head.

By means of the invention, an operator is provided with a tool whose freedom of movement is restricted only by the flexibility of the connection of the vacuum source, that is, solely by the vacuum cleaner hose. With the cutting head, it is possible to loosen the deposited material and simultaneously remove the loosened particles by a suction operation. It is not necessary to invert any elements in the area of the surface to be cleaned, such as in the prior art.

In the tool embodying the present invention, the impact element is positioned on one end of a tubular member which performs the stroke-like movement and the other end of the tubular member is located at the connection to the vacuum source. This arrangement permits a very compact tool.

Another feature of the tool embodying the present invention is the formation of the impact element as a bundle of needles with the bundle located centrally within the tubular member so that suction openings are provided.

In principle, the invention is not limited to this one construction of the impact element including the needle bundle. As an alternative, individual impact pins can be used and/or the needles can be arranged on the tubular member as a needle ring or similar arrangement.

In a preferred embodiment of the present invention, the tubular member forms the core of an electromagnet. This arrangement affords a more compact tool which is particularly adapted for manual operability.

In accordance with the present invention, the tubular member can be biased in one direction of its stroke by a spring, so that if the tubular member forms the core of an electromagnet a simplified arrangement is afforded, since it is only necessary for the coil to move the coil in one direction during current flow, that is, against the biasing action of the spring and it does not matter whether the impacting action is provided by the coil or by the spring.

In addition to the embodiments mentioned above, other arrangements for effecting the stroke-like movement of the present invention are possible, for instance, by employing electromotor eccentric drives, drives utilizing a connecting link element with lands and grooves, and similar devices.

A preferred feature of the invention is the use of a brush ring or collar around the cutting head with the tips of the brush bristles facing in the same direction as the tips of the needle bundle. With this arrangement, it is possible to effect a considerable pre-cleaning of the surface by means of brushing and suctioning without employing the impact element. After the pre-cleaning of the incrusted or burned-in impurities, the impact element can be used to complete the cleaning step.

Another feature of the invention is the provision of a handle on the tool with at least one actuating switch in the handle.

It is preferable if the tubular member is supported in plastics material sliding bearings so that the tool can be operated with a minimum amount of maintenance.

Yet another feature of the invention is the arrangement of the brush ring, and the impact element, such as the needle bundle, as detachable parts of the tool. If these parts are detachable, the brush ring or the impact element can be replaced either after a period of wear or to accommodate a particular use, so that the needle bundle can be replaced by a needle ring or one or more impact pins.

In another preferred embodiment of the invention, the electromagnet core is formed of two axially extending parts, one following the other with the parts encircling the tubular member. The tubular member is formed of a non-ferrous material, such as brass. One part of the core is fixed to the winding of the electromagnet and the other part is fixed to the tubular member.

This division of the core of the electromagnet into two parts produces the oscillation of the centrally arranged tubular member when current is turned on without requiring a restoring force using springs, or the like. A simple spring ring can be used as a spacer element between the axially aligned core parts.

Basically, the needle bundle can be positioned on the front end of the oscillating tubular element. In this embodiment the core part fixed to the tubular member acts on a ring disc facing in the direction of the impact element and the ring disc, in turn, acts on the needle bundle which is spring-loaded.

It should be noted that the tubular member in this embodiment is not limited to a non-ferrous material, such as brass and the like, instead a plastics material, graphite or similar material could also be used.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
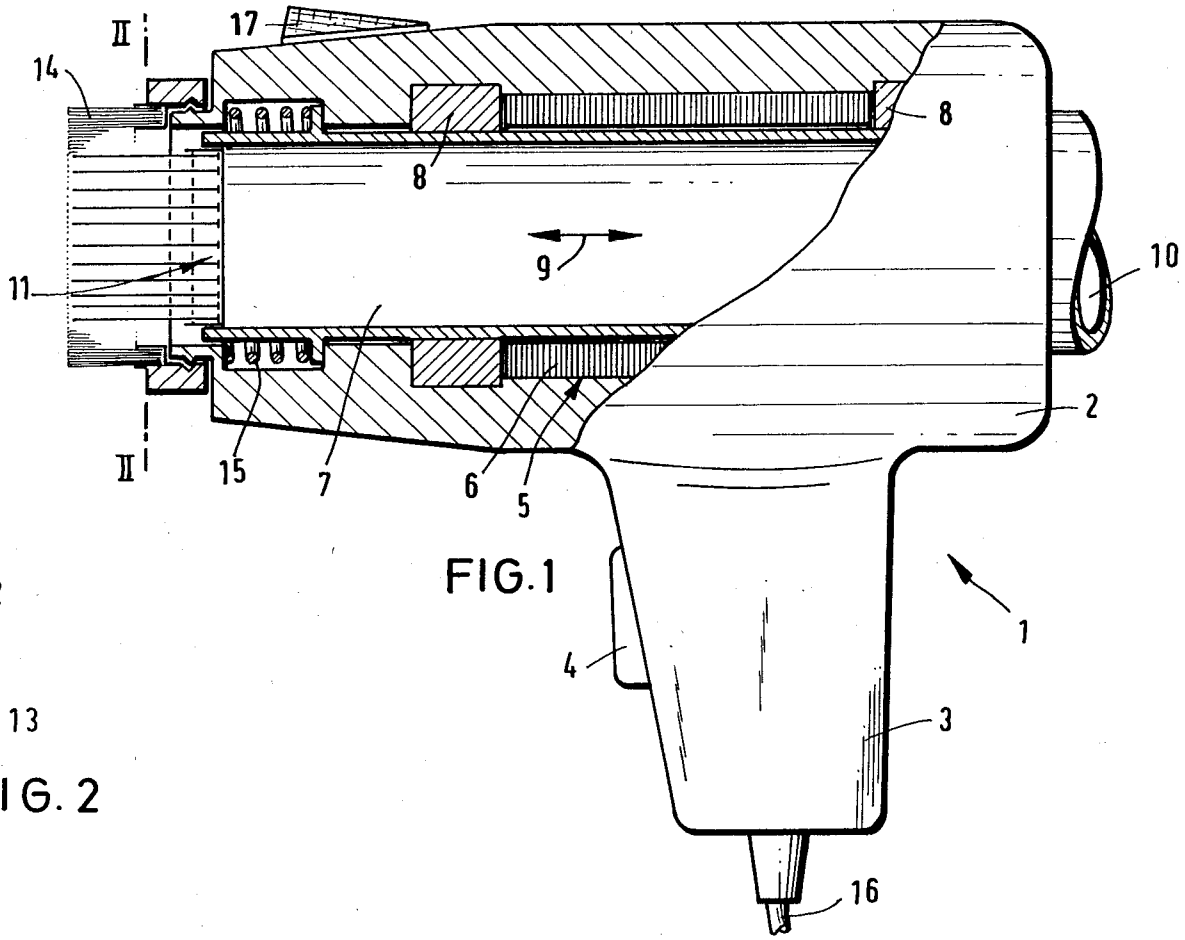
FIG. 1 is a simplified side view, partly in section, of a tool embodying the present invention.

As illustrated in FIG. 1, the present invention is directed to a manually operable tool in the form of a cutting head 1 with a housing 2 and a handle 3 depending from the housing. At least one on/off switch 4 is located in the handle 3.

An electromagnet 5 is located within the housing 2 and includes a winding 6 and a core in the form of an axially extending tubular member 7.

The hollow core 7 of the electromagnet 5 is supported within the housing 2 in sliding bearings 8 and it is arranged so that it can perform a stroke-like movement reciprocating in the direction of the double arrow 9.

As viewed in FIG. 1, the left-hand end of the tubular member 7 is at the front end of the tool and the right-hand end is at the rear end of the tool. At the rear end of the housing 2, a connection 10 is provided for communication with a vacuum source. The connection 10 is shown only in a simplified manner and is located at the rear end of the tubular member 7. An impact element 11 is located at the front end of the tubular member 7. The impact element 11 is in the form of a needle bundle 12 removably secured on the front end of the tubular member 7 so that it can be replaced, if necessary.

Figure 2:
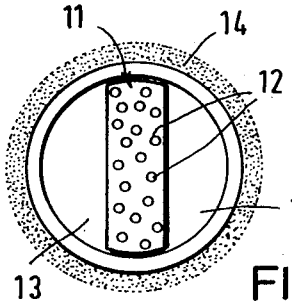
FIG. 2 is a sectional view taken along the line II—II in FIG. 1.

As can be seen in FIG. 2, the needle bundle 12 is positioned at the opening from the first end of the tubular member 7 so that it forms a band extending across the cross section of the opening leaving two segment-shaped areas 13 open so that the suction acting through the opening 10 is effective on the surface being cleaned.

At the front end of housing 2, a brush ring 14 is arranged coaxially with and extends around the end of the tubular member 7 encircling the needle bundle 12. The brush ring 14 is detachably mounted on the housing 2.

In one possible use of the tool the connection 10 at the rear end of the housing 2 is placed in communication with a vacuum source. Since the vacuum source is in working communication with the interior of the tubular member 7, air can be suctioned from the areas 13 on the opposite sides of the needle bundle 12. By actuating the on/off switch 4, the core or tubular member 7 is reciprocated or oscillated in the direction of the double arrow 9 so that the needle bundle 12 executes a reciprocating stroke. When a surface is to be cleaned using the tool, the brush ring 14 encloses and forms a seal around the surface and the needle bundle 12 so that a high suction action can be attained.

The brush ring encloses the area to be cleaned in a comparatively air-tight manner.

In a different operational procedure, the electromagnet 5 moves the tubular member 7 in only one direction of the double arrow 9. If the winding 6 is operated in this manner, a compression spring 15 acting at the forward end of the tubular member 7, note FIG. 1, biases the tubular member in the direction opposite to the direction in which it is moved by the winding.

In the embodiment illustrated, the tool 1 is supplied with current via a cable 16. Similarly, the vacuum cleaner cable can also be provided with an electric cable as in present day household vacuum cleaners. In this embodiment, the electrical supply is provided in the region of the connection 10 at the rear end of the tool. The electrical operation of the tool can be effected with an on/off switch for the vacuum source located on the housing 2 of the tool 1 in addition to the on/off switch 4 for carrying out the stroke-like movement of the impact element 11.

It will be appreciated that the above described embodiment can be modified in a number of ways without departing from the basic concept of the invention. Accordingly, the invention is not limited, in particular, to an electromagnetic drive for the impact element. Mechanical drives, such as eccentrics or the like, can also be used. A light source 17, can be mounted on the housing 1 facing toward the front end of the tubular member so that it is easier to operate the tool 1 for cleaning parts of the motor truck which are not easily accessible and, as a rule, are not easily illuminated.

Figure 3:
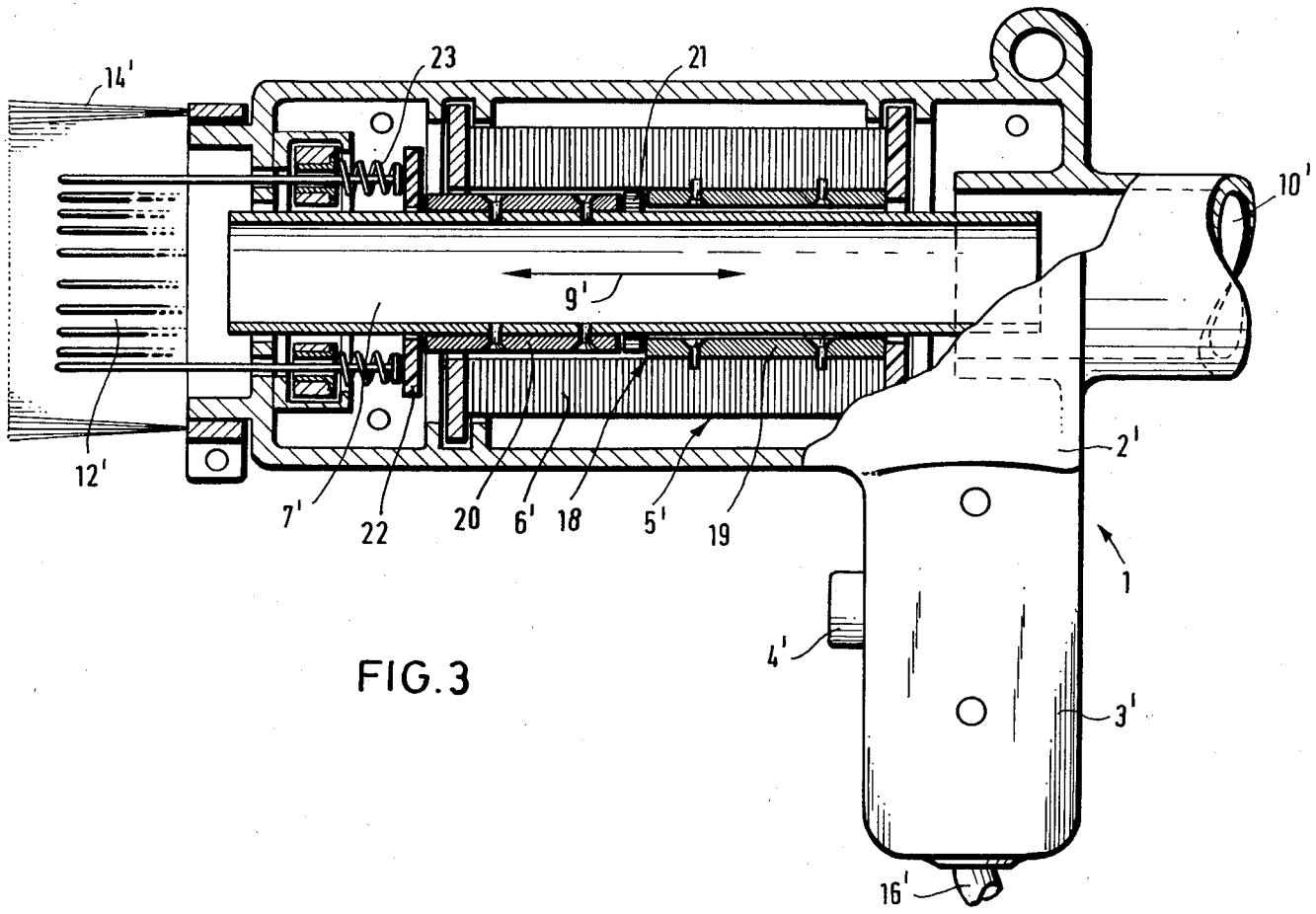
FIG. 3 is a side view, partly in section, as in FIG. 1 and illustrating another embodiment of the invention.

In FIG. 3 another embodiment of the invention is illustrated and, similar to FIG. 1, it is a side view, partly in section.

The component parts shown in FIG. 3 having a similar function to those in FIG. 1 bear the same reference numeral, however, with the addition of a prime (').

The significant difference over the embodiment illustrated in FIG. 1 is that the winding 6' of the electromagnet 5' encloses a divided core 18 formed of two axially aligned core parts 19, 20, one behind the other. The core part 20 is closer to the front end of the tubular member 7' and it is followed in the rearward direction of the tool by the other core part 19. Core part 19 is fixed to the winding 6', while the other core part 20 is fixed to the tubular member 7'. A simple spring ring 21 acts as a spacer element between the core parts 19, 20. The tubular member 7' is formed of a non-magnetic material, such as brass or the like.

By applying current to the electromagnet 5', the tubular member 7' starts to oscillate due to the division of the core into two parts with the oscillating action shown by the double arrow 9'. As the tubular member oscillates the front end of the core part 20, that is the end facing the needle bundle 12' impacts against a ring disc 22 which encircles the tubular member. The ring disc 22, in turn, acts against the rear side of the needle bundle 12'. In this embodiment the needle bundle 12' is an annular member. Each needle in the bundle is equipped with a small spring 23 to ensure the return stroke of the needles. Further, in this embodiment an additional support for the tubular member 7' is unnecessary. The tubular member is adequately supported solely by the core construction.

While specific embodiments of the invention have been shown and described in detail to illustrate the application of the inventive principles, it will be understood that the invention may be embodied otherwise without departing from such principles.

I claim:

1. A tool for removing solid material deposits on surfaces to be cleaned, particularly for cleaning material from brake drums of motor vehicles and for removing the material, comprising means for loosening and cleaning the deposited solid material and means for removing the loosened material from the cleaned surface, said cleaning means comprises a manually operable cutting head including an impact element arranged to effect a stroke-like movement, and said removing means comprising a connection on said cutting head for placement in communication with a vacuum source, said cutting head includes an axially extending tubular member having a first end and a second end with said impact element located at the first end thereof, said tubular member arranged to perform the stroke-like movement and to transmit such movement to said impact element, means for forming a seal laterally enclosing said impact element, and said connection located at the second end of said tubular member so that the loosened material is removed through said tubular member from the laterally sealed space at the first end of said tubular member.

2. A tool, as set forth in claim 1, wherein said impact element comprises a needle bundle.

3. A tool, as set forth in claim 2, wherein said needle bundle is centrally arranged in the cross-section at the first end of said tubular member so that suction openings are provided in the first end adjacent said needle bundle.

4. A tool, as set forth in claim 2, wherein said means for forming a seal includes a brush ring laterally encircling said needle bundle and said brush ring and needle bundle each having free ends facing in the direction outwardly from the first end of said tubular member.

5. A tool, as set forth in claim 4, wherein said impact element and said brush ring are detachably mounted on said tubular member.

6. A tool, as set forth in claim 1, including a housing, an electromagnet located within said housing and including a winding and a core, and said tubular member forms said core of said electromagnet.

7. A tool, as set forth in claim 1, including a housing, said tubular member mounted within said housing, and a spring mounted within said housing and disposed in contact with said tubular member for biasing said tubular member in one direction of the stroke-like direction.

8. A tool, as set forth in claim 1, including a housing enclosing said tubular member, a handle secured to said housing, and at least one actuating switch mounted in said handle.

9. A tool, as set forth in claim 1, including a housing enclosing said tubular member, plastics material sliding bearings located within said housing and slidably supporting said tubular member.

10. A tool, as set forth in claim 1, including a housing, an electromagnet located within said housing and including a winding and a core located within said winding, said core comprises a first core part and a second core part, one following the other in the axial direction of said tubular member, each of said core parts encircles said tubular member, said tubular member is formed of a non-magnetic material, said first core part is fixed to said tubular member and said second core part is fixed to said winding.

11. A tool, as set forth in claim 10 wherein said tubular member is formed of a non-ferrous metal.

12. A tool, as set forth in claim 11, wherein said tubular member is formed of brass.

13. A tool, as set forth in claim 11, wherein each of said core parts is a cylindrical element, and a spring ring spaces the adjacent ends of said core parts.

14. A tool, as set forth in claim 10, wherein said first core part is located closer to said impact element, said impact element comprises a needle bundle made up of a number of individual needles, a ring disc is provided encircling said tubular member at the end of said first core part closer to said needle bundle so that said first core part acts on said ring disc and, in turn, said ring disc acts on said needle bundle.

15. A tool, as set forth in claim 14, wherein each of said needles has a spring encircling the end thereof contacting said ring disc and said spring is arranged to return said needle after it has been impacted via said ring disc.

* * * * *